US007415797B2

(12) United States Patent
Dotson et al.

(10) Patent No.: US 7,415,797 B2
(45) Date of Patent: Aug. 26, 2008

(54) IMPACT RESISTANT TILT WINDOW ASSEMBLY

(75) Inventors: Cynthia A. Dotson, West Union, WV (US); Thomas D. Riggs, Pennsboro, WV (US); Charles D. Kownacki, Erie, PA (US); Jimmie D. Daniels, Jr., Harrisville, WV (US); Mark B. Marvin, Salem, WV (US); Stephen T. Mansfield, Beaver Falls, PA (US); Craig J. Lawson, Slippery Rock, PA (US); Philip S. Blake, Pennsboro, WV (US); Randall D. Burr, Wallace, WV (US)

(73) Assignee: Simonton Building Products, Inc., Parkersburg, WV (US)

( * ) Notice: Subject to any disclaimer, the term of this patent is extended or adjusted under 35 U.S.C. 154(b) by 339 days.

(21) Appl. No.: 10/835,738

(22) Filed: Apr. 30, 2004

(65) Prior Publication Data

US 2005/0016066 A1 Jan. 27, 2005

Related U.S. Application Data

(60) Provisional application No. 60/467,211, filed on May 1, 2003.

(51) Int. Cl.
*E05D 15/22* (2006.01)

(52) U.S. Cl. ..... 49/185

(58) Field of Classification Search ..... 49/183–185; 292/6, 42, 24, 31, 143, 163, 164, DIG. 20, 292/DIG. 47; 16/324, 326, 327, 332
See application file for complete search history.

(56) References Cited

U.S. PATENT DOCUMENTS 4,726,148 A * 2/1988 Tix ..... 49/453
4,901,475 A * 2/1990 Simpson ..... 49/175
5,014,466 A 5/1991 Winner
5,446,997 A 9/1995 Simonton
5,657,579 A 8/1997 Bruchu et al.
5,934,031 A * 8/1999 deNormand ..... 52/204.5
6,016,588 A * 1/2000 Kamerschen ..... 16/82
6,112,463 A 9/2000 Reithmeyer et al.

(Continued)

FOREIGN PATENT DOCUMENTS

GB 2109043 A * 5/1983

*Primary Examiner*—Jerry Redman
(74) *Attorney, Agent, or Firm*—Calfee Halter & Griswold LLP

(57) ABSTRACT

An impact resistant tilt window assembly includes a window frame with side jambs that have legs that extend in the direction of the exterior of the frame, an upper sash, a lower sash that moves vertically and tilts inwardly and tilt latch assemblies that are positioned on the lower sash, each tilt latch assembly includes a latch bolt with a nose end that includes a notch that is sized to engage the associated jamb leg when the lower sash is in a vertical orientation. The notch has an interior leg that moves along an interior side of the jamb leg and an exterior leg that extends behind an exterior side of the jamb leg and moves along the jamb leg when the sash moves vertically. The window assembly may further include U-shaped reinforcing inserts that are positioned within the jambs such that the tilt latch assemblies engage the inserts when the lower sash is in the closed position.

4 Claims, 4 Drawing Sheets

U.S. PATENT DOCUMENTS 6,178,696 B1 * 1/2001 Liang ..... 49/185
6,385,924 B1 5/2002 Emek
7,069,694 B2 * 7/2006 Fullick ..... 49/183

* cited by examiner

IMPACT RESISTANT TILT WINDOW ASSEMBLY

CROSS-REFERENCE TO RELATED APPLICATIONS

The present application claims the benefit of U.S. Provisional Patent Application Ser. No. 60/467,211, which was filed on May 1, 2003, by Dotson et al. for an IMPACT RESISTANT TILT WINDOW ASSEMBLY and is hereby incorporated by reference.

BACKGROUND OF THE INVENTION

1. Field of the Invention

The invention relates generally to tilt window assemblies and, in particular, to tilt window assemblies that include tilt latch mechanisms that hold the window sashes in place during a sudden exterior impact.

2. Background Information

Tilt window assemblies, in which at least a lower sash tilts-inwardly are well known. Unlike traditional double hung window assemblies, the lower sashes of the tilt window assembly do not ride rigidly within the side jambs of the window frame. The tilt window assemblies instead include one or more tilt latches with latch members that extend into the window frame side jambs, to prevent the lower sash from tilting. The user pivots or slides the latch members out of the jambs, to allow the sash to tilt inwardly.

One of the known problems with tilt window assemblies is that they react adversely to sudden impacts, such as high winds and/or flying debris. For example, the lower sash may flex to the point where the latch members disengage from the jambs or cause the jambs to crack or break. The sash and the glass included therein may then crack and/or blow into or out of the house, depending on positive or negative pressure at the time of impact.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1A:
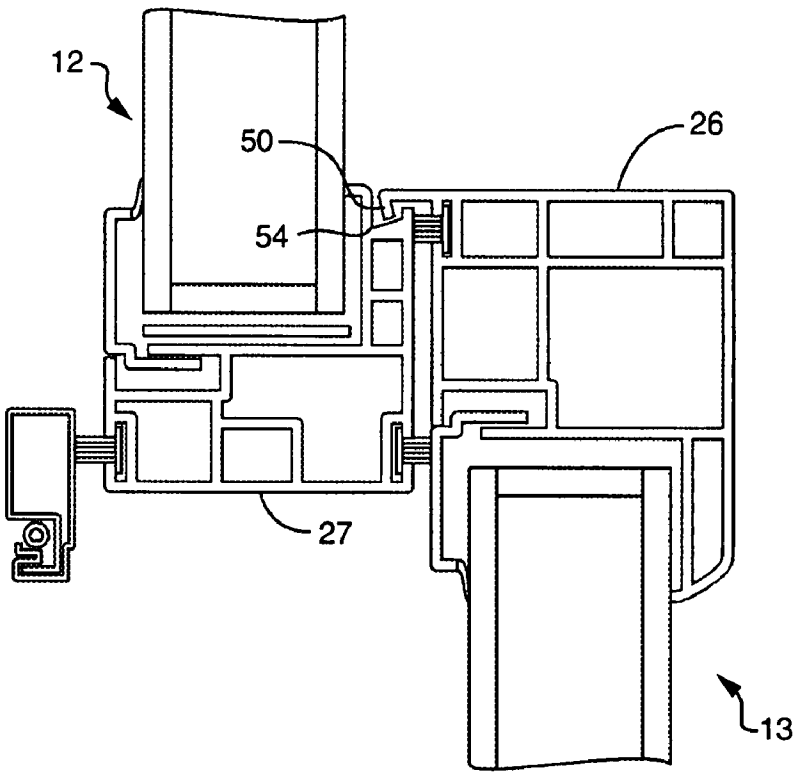
FIG. 1A is a sectional view taken along line 1A-1A of FIG. 1.
Figure 1:
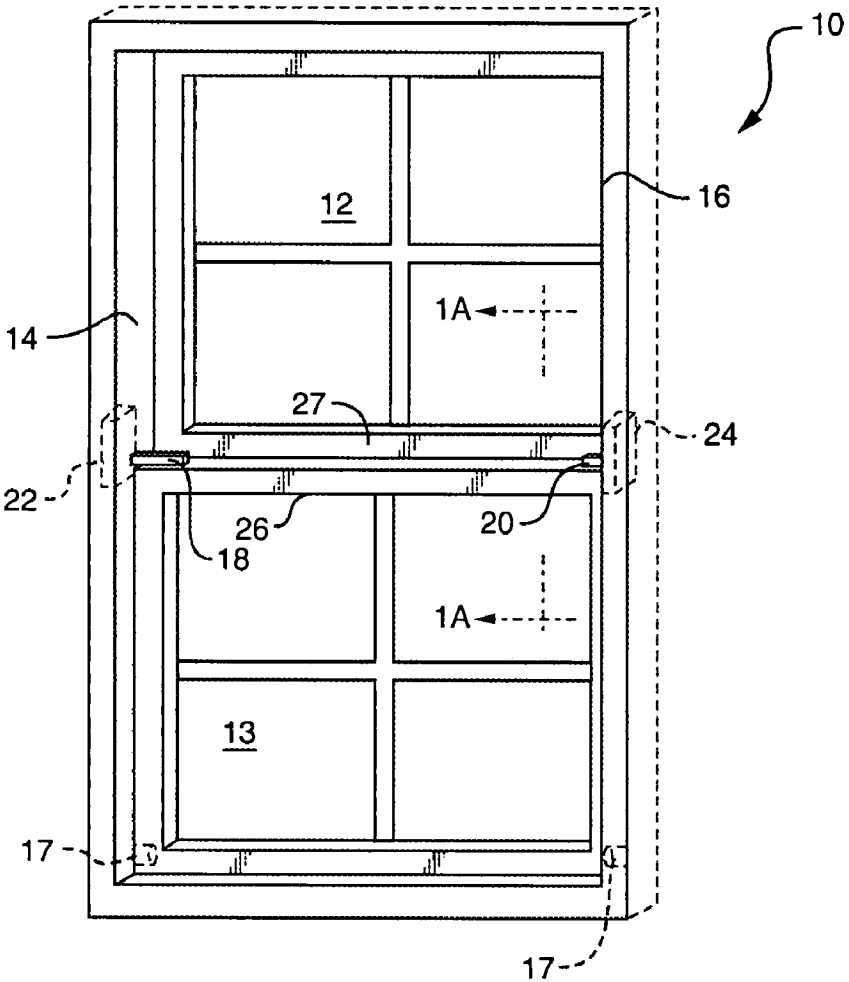
FIG. 1 depicts a window assembly constructed in accordance with the invention.

Referring now to FIG. 1 a tilt window system 10 includes an upper sash 12 and a lower sash 13. The upper and lower sashes 12, 13 move vertically within window frame jambs 14 and 16. At least the lower sash 13 also moves about pivot points 17,17 to tilt inwardly for cleaning and so forth. When the lower sash is in the closed position, as depicted in the drawing, tilt latches 18 and 20 engage frame reinforcing inserts 22 and 24. The tilt latches and frame reinforcing inserts are discussed in more detail with reference to FIGS. 2-5 below. When the lower sash 13 is raised, the latches 18 and 20 engage the jambs 14, 16, rather than the frame reinforcing inserts 22, 24. As also discussed in more detail below, the tilt latches 18 and 20 enable the window assembly to withstand a sudden impact, such as high force winds, without shattering or blowing in.

Figure 2:
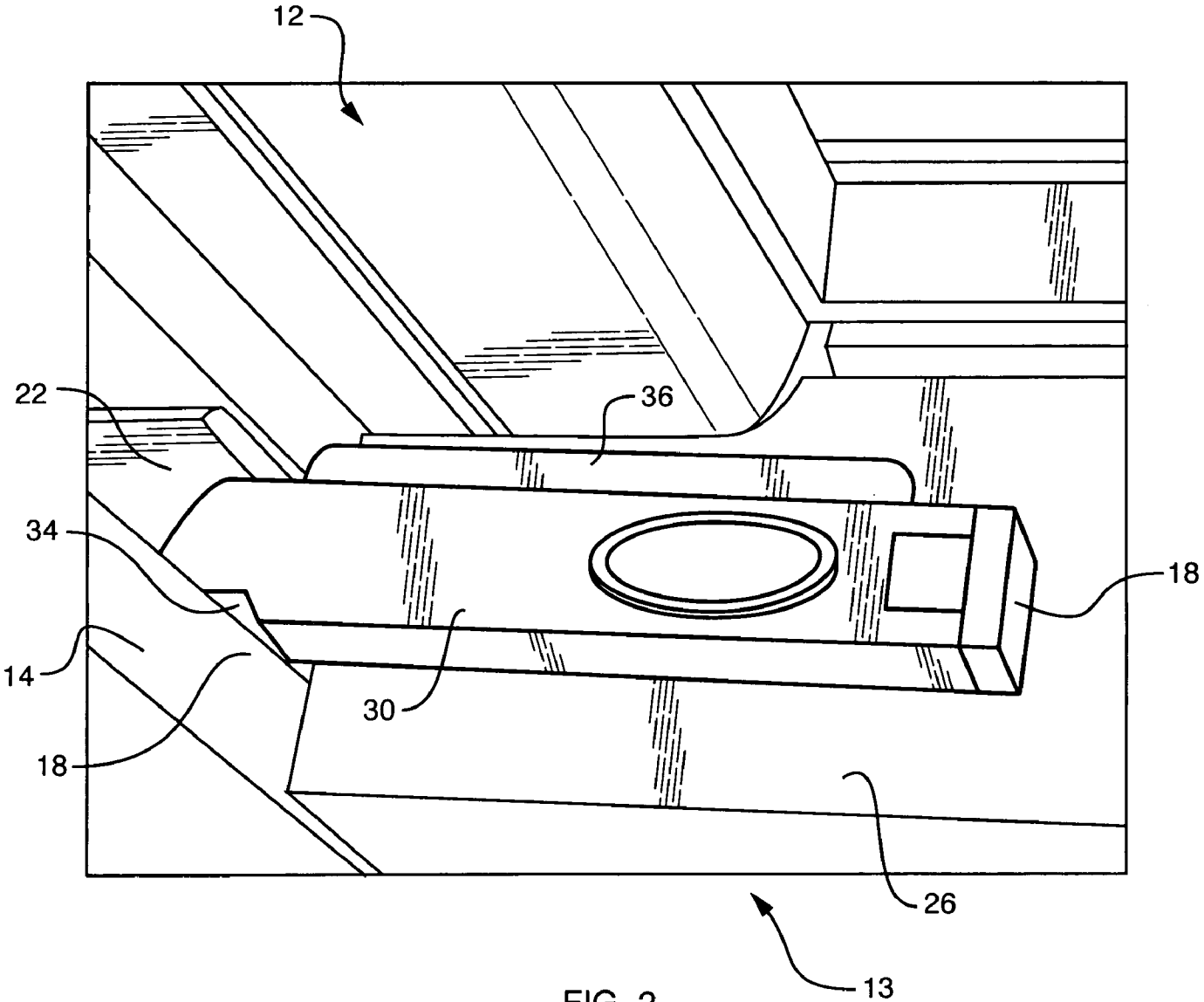
FIG. 2 is a more detailed depiction of a tilt latch assembly included in the window assembly of FIG. 1.
Figure 3:
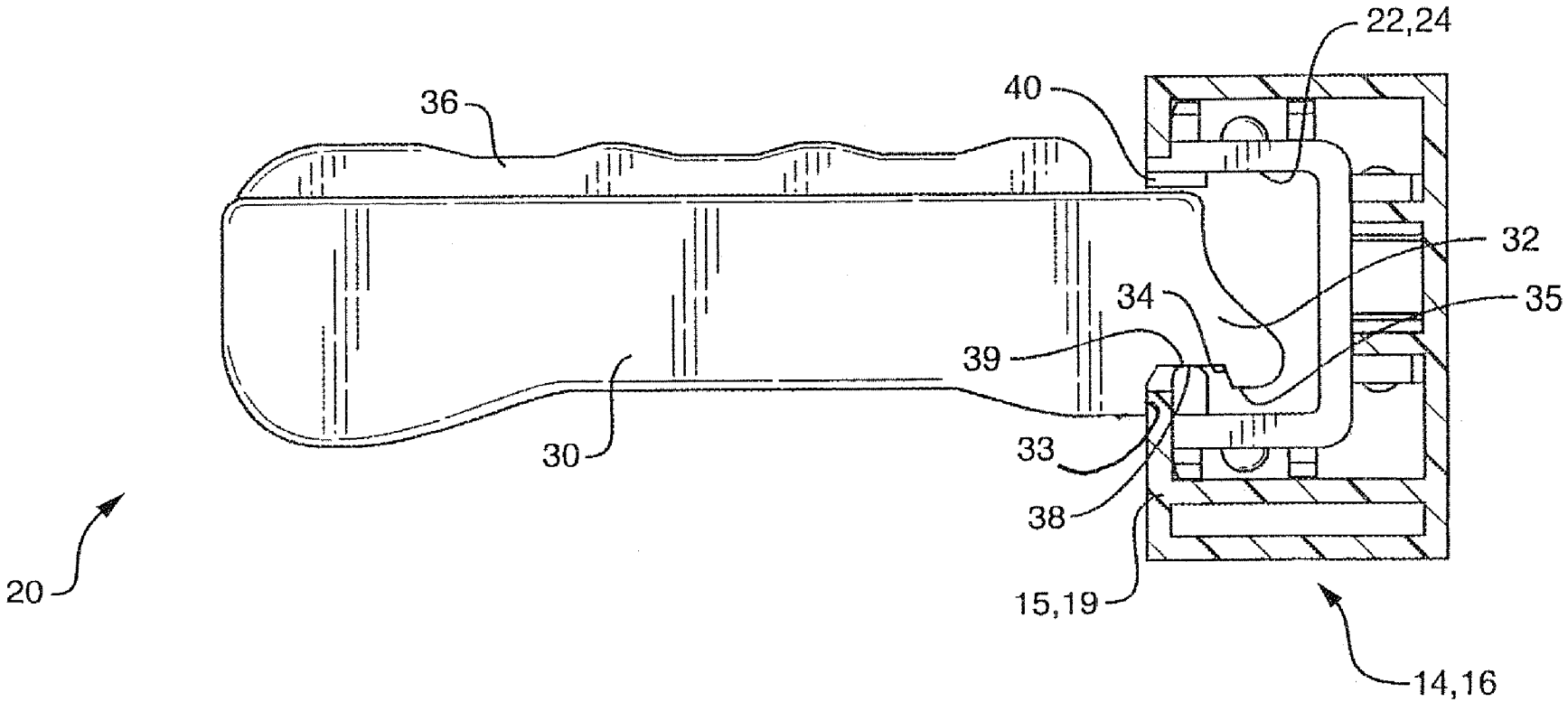
FIG. 3 is a top view of the tilt latch assembly of FIG. 2.
Figure 4:
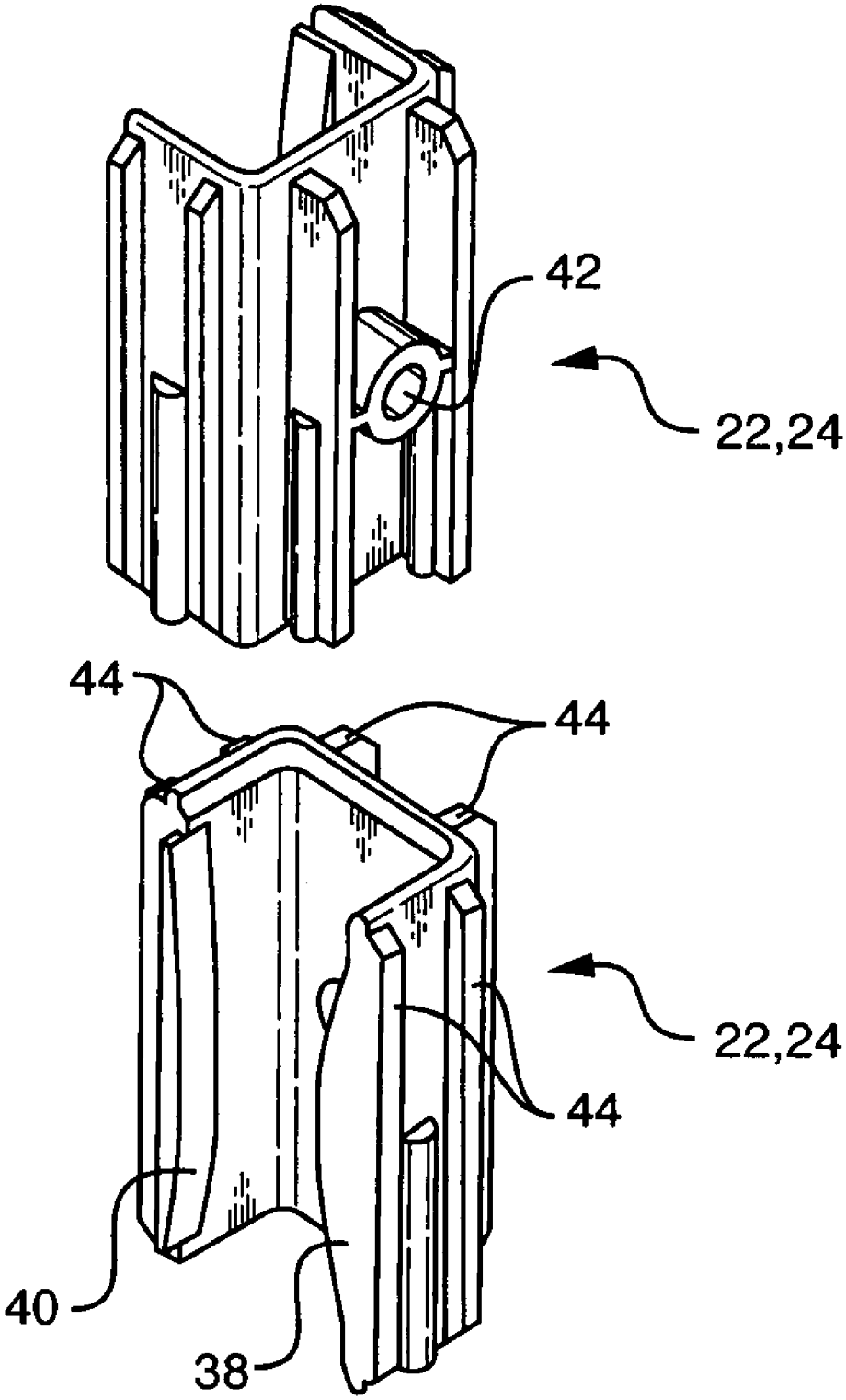
FIG. 4 depicts in more detail a frame reinforcing insert of FIG. 1.

Referring now to FIGS. 2 and 3, the tilt latch assemblies 18 and 20 are shown in more detail. The tilt latch assemblies 18 and 20 are essentially identical with interior facing edges that are shaped to cooperate with the frame reinforcing inserts 22, 24 and the window frame jambs 14, 16. Specifically, the tilt latch assembly includes a shaped latch bolt 30 that is slidably mounted on the top of a lock or meeting rail 26 of the lower sash 13. The latch bolt has a shaped nose 32 with a notch 34 that includes an inner leg 33 that rides along the interior side of jamb leg 15, 19. The notch 34 further includes an outer leg 35 that engages the insert 22, 24 when the sash 13 is in the closed position and the exterior side of the jamb leg 15, 19 when the sash is raised. The latch bolt 30 also retracts by sliding toward the middle of the meeting rail, to allow the lower sash 13 to tilt inwardly, as described below.

As depicted in the drawings, the tilt latch assembly 18 also includes a hand grip 36, which provides a hand hold for the user to grip while directing the lower sash to or from the tilted position. As shown in the drawings, the nose 32 of the latch bolt 30 is tapered, to accommodate spiral balance mechanisms (not shown). The nose may instead be square or any other shape, depending upon the balance mechanism used in the window assembly.

As shown in more detail in FIG. 3, the frame reinforcing inserts 22, 24 are U-shape shaped, and are relatively short, in the 1 to 2 inch range. The two inserts are strategically positioned within the jambs 14, 16 to cooperate with the tilt latches. The two inserts 22, 24 are essentially identical, except that on each a shaped ramp 38 is located on the interior side of the insert and a smaller guide 40 is located on the opposite side of the insert. As shown also in FIG. 4, the ramp 38 is essentially bow-shaped, such that the ramp guides the lower sash in the direction of the exterior of the window frame, and into a desired position relative to the upper sash 12. The ramp 38 is widest at its center, such that the ramp guides the lower sash into a position relative to the upper sash in which a projection 50 in the lock rail 26 of the lower sash 13 interfits and interlocks with a channel 54 in the bottom rail 27 of the upper sash, as discussed in U.S. Pat. No. 5,446,997, which is incorporated herein in its entirety by reference. The guide 40 may be similarly bow-shaped, as necessary to properly position the lower sash. Alternatively, the guide 40 may be essentially flat.

When a user desires to tilt the lower sash 13, the user first raises the lower sash until the latch bolts 30 are positioned above the inserts 22, 24. The user then pushes the lower sash slightly outwardly, to disengage the outer legs 35 of latch bolt notches 34 from the jamb legs 15, 19. The user next retracts the latch bolts 30 until the noses 32 of the respective bolts are clear of the jambs, and holding onto the hand grips 36, the user tilts the lower sash inwardly in a controlled manner.

When the user wishes to move the lower sash 13 to the non-tilted position, the user holds the latch bolts 30 in the retracted positions and directs the lower sash into a vertical orientation. The user then pushes the lower sash slightly outwardly, such that the outer legs 35 of the respective notches 34 extend behind the jamb legs 15, 19 and releases the latch bolts 30. Springs (not shown) within the tilt latches force the latch bolts into the extended position, as depicted in FIGS. 2 and 3, to hold the lower sash in its vertical orientation and against inward movement. As desired, the user lowers the lower sash 13, such that the notches 34 ride along the ramps 38, to direct the lower sash into the desired alignment with the upper sash 12.

When the lower sash 13 is lowered to the closed position, the leg 35 of the notch 34 extends sufficiently beyond the edge 39 of the ramp 38, such that the latch bolt 30 remains in engagement with the frame reinforcing insert 22, 24 even if a sudden impact should strike the exterior of the assembly.

The frame reinforcing inserts 22, 24 essentially distribute forces applied to them by the tilt latches in response to a sudden impact on the exterior of the assembly. The inserts 22, 24 do not move or deform, and the tilt latches are retained in their pre-impact positions. Accordingly, the assembly responds in a more rigid manner to the impact and the latch bolts, whether shaped to engage the inserts as discussed above or not, do not tend to move within or disengage from the jambs.

Referring again to FIG. 4, the channel insert 22, 24 is depicted with molded spacers 44 that position the insert properly within the jambs 14, 16. A screw boss 42 is also molded into the insert, such that the insert can be screwed into the jamb. The spacers 44 are strategically located around the periphery of the insert, to provide tortional stability. Accordingly, less material may be used in the insert. Alternatively, the insert may be formed as a solid U-shaped device. If the insert is used with a conventional tilt latch, the insert may but need not include the ramp 38.

We have described the tilt latch assemblies 18 and 20 as including notches 34 that cooperate with the frame reinforcing inserts 22 and 24. As discussed, the notches engage the inserts to provide an extremely robust mechanism that protects against the blowing in of the window assembly in response to a sudden impact. Further, the interaction of the notches 34 and the window frame jambs 14, 16 prevents the tilt latch from unintentionally disengaging when the lower sash is in a raised position. If the jamb 14, 16 is sufficiently rigid, the inserts may not be required and the jamb legs 15 and 19 may instead be shaped to guide the lower sash into a desired position relative to the upper sash. The relative movement of the locking rail is then not sufficient to allow the shaped latch bolts 30 to unintentionally disengage from the jambs.

What is claimed is:

1. An impact resistant tilt window assembly including:

a window frame including side jambs with legs that extend in the direction of the exterior of the frame;

an upper sash;

a lower sash that moves vertically between fully open and closed positions and also tilts inwardly; and tilt latch assemblies that are positioned on the lower sash, each tilt latch assembly including a latch bolt with a nose end that includes a notch that is sized to engage the associated jamb leg when the lower sash is in a vertical orientation, the notch having an interior leg that slidably engages an interior side of the jamb leg during the entire vertical movement of the lower sash between said positions and an exterior leg that extends behind an exterior side of the jamb leg and moves along the jamb leg during the entire vertical movement of the lower sash between said positions, whereby the latch bolts center the lower sash during the entire vertical movement thereof.

2. The impact resistant tilt window assembly of claim 1 further including frame reinforcing inserts that are positioned in the jambs to cooperate with the tilt latch assemblies, the frame reinforcing inserts being U-shaped with an interior leg that is engaged by the notch in the latch bolt when the lower sash is moved to said closed position.

3. The impact resistant tilt window assembly of claim 2 further including on the upper sash, a meeting rail that includes a channel;

on the lower sash, a lock rail that includes a projection that is sized to fit within the channel of the upper sash when the lower sash is in the closed position; and on the frame inserts, shaped ramps that guide the tilt latch assemblies and the attached lower sash into an orientation in which the projection is directed into the channel on the upper sash.

4. An impact resistant tilt latch assembly including a window frame including side jambs with legs that extend in the direction of the exterior of the frame;

an upper sash;

a lower sash that moves vertically between fully open and closed positions and also tilts inwardly;

tilt latch assemblies that are positioned on the lower sash, each tilt latch assembly including a latch bolt that extends into the corresponding jamb when the lower sash is moved vertically between said positions; and U-shaped frame reinforcing inserts that fit within the jambs at the locations at which the latch bolts are positioned when the lower sash is in said closed position, each latch bolt having an interior leg which slides along the associated jamb during the entire vertical movement of the lower sash between said positions and an exterior leg which extends behind an exterior surface of the associated reinforcing insert to prevent unwanted release of each latch assembly when the lower sash is in said closed position and the sashes are impacted by an exterior force.

* * * * *